US009945604B2

(12) United States Patent
Ott et al.

(10) Patent No.: US 9,945,604 B2
(45) Date of Patent: Apr. 17, 2018

(54) INTEGRATED NITROGEN REMOVAL IN THE PRODUCTION OF LIQUEFIED NATURAL GAS USING REFRIGERATED HEAT PUMP

(71) Applicant: AIR PRODUCTS AND CHEMICALS, INC., Allentown, PA (US)

(72) Inventors: Christopher Michael Ott, Laurys Station, PA (US); Gowri Krishnamurthy, Lansdale, PA (US); Fei Chen, Whitehouse Station, NJ (US); Yang Liu, Allentown, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 575 days.

(21) Appl. No.: 14/260,753

(22) Filed: Apr. 24, 2014

(65) Prior Publication Data

US 2015/0308738 A1 Oct. 29, 2015

(51) Int. Cl.
*F25J 1/00* (2006.01)
*F25J 3/00* (2006.01)
(Continued)

(52) U.S. Cl.
CPC ..... *F25J 3/0257* (2013.01); *F25J 1/0022* (2013.01); *F25J 1/0025* (2013.01); *F25J 1/0042* (2013.01);
(Continued)

(58) Field of Classification Search
CPC ..... F25J 1/0022; F25J 1/0025; F25J 1/0212; F25J 1/0211; F25J 1/0239; F25J 1/0241; F25J 3/0209; F25J 3/0257; F25J 3/0233; F25J 2270/66; F25J 2270/14; F25J 2270/16; F25J 2200/70; F25J 2200/72;
(Continued)

(56) References Cited

U.S. PATENT DOCUMENTS 3,596,473 A 8/1971 Streich
3,721,099 A 3/1973 Forg et al.
(Continued)

FOREIGN PATENT DOCUMENTS

DE 102009015766 A1 10/2010
DE 102011109234 A1 2/2013
(Continued)

OTHER PUBLICATIONS

IP.COM000222164D, Nitrogen Rejection Unit (NRU) Configurations.
(Continued)

*Primary Examiner* — Keith Raymond
(74) *Attorney, Agent, or Firm* — Eric J. Schaal

(57) ABSTRACT

A method for liquefying a natural gas feed stream and removing nitrogen therefrom, the method comprising passing a natural gas feed stream through a main heat exchanger to produce a first LNG stream, and separating a liquefied or partially liquefied natural gas stream in a distillation column to form nitrogen-rich vapor product, wherein a closed loop refrigeration system provides refrigeration to the main heat exchanger and to a condenser heat exchanger that provides reflux to the distillation column.

17 Claims, 4 Drawing Sheets

(51) Int. Cl.
*F25J 3/02* (2006.01)
*F25J 1/02* (2006.01)

(52) U.S. Cl.
CPC ..... *F25J 1/0055* (2013.01); *F25J 1/0212* (2013.01); *F25J 1/0238* (2013.01); *F25J 3/0209* (2013.01); *F25J 3/0233* (2013.01); *F25J 2200/02* (2013.01); *F25J 2200/76* (2013.01); *F25J 2205/04* (2013.01); *F25J 2210/90* (2013.01); *F25J 2215/04* (2013.01); *F25J 2230/08* (2013.01); *F25J 2240/30* (2013.01); *F25J 2245/90* (2013.01); *F25J 2270/18* (2013.01); *F25J 2270/66* (2013.01)

(58) Field of Classification Search
CPC .. F25J 2200/74; F25J 2200/76; F25J 2220/62; Y10S 62/927
See application file for complete search history.

(56) References Cited

U.S. PATENT DOCUMENTS

| | | | | |
|---|---|---|---|---|
| 3,747,359 | A | 7/1973 | Streich | |
| 4,225,329 | A | 9/1980 | Bailey et al. | |
| 4,411,677 | A | 10/1983 | Pervier et al. | |
| 4,504,295 | A | 3/1985 | Ott et al. | |
| 4,878,932 | A | 11/1989 | Phade et al. | |
| 6,192,705 | B1 | 2/2001 | Kimble | |
| 6,199,403 | B1 | 3/2001 | Cole et al. | |
| 6,401,486 | B1 * | 6/2002 | Lee | F25J 1/0022 62/623 |
| 6,837,071 | B2 | 1/2005 | Oakey | |
| 7,520,143 | B2 | 4/2009 | Spilsbury | |
| 8,522,574 | B2 | 9/2013 | Crawford et al. | |
| 2002/0194866 | A1 | 12/2002 | Oakey | |
| 2003/0177786 | A1 | 9/2003 | O'Brien | |
| 2004/0231359 | A1 * | 11/2004 | Brostow | C10L 3/10 62/623 |
| 2007/0157663 | A1 * | 7/2007 | Mak | F25J 1/0022 62/620 |
| 2009/0277217 | A1 * | 11/2009 | Ransbarger | F25J 1/0022 62/612 |
| 2010/0077796 | A1 | 4/2010 | Gadre et al. | |
| 2011/0041389 | A1 | 2/2011 | Bauer et al. | |
| 2011/0226009 | A1 | 9/2011 | Paradowski et al. | |
| 2011/0289963 | A1 | 12/2011 | Price | |
| 2012/0019883 | A1 | 1/2012 | Chae et al. | |
| 2012/0285196 | A1 | 11/2012 | Flinn et al. | |
| 2014/0345319 | A1 * | 11/2014 | Corte Real Santos | F25J 1/0255 62/618 |
| 2015/0135767 | A1 | 5/2015 | Currence et al. | |

FOREIGN PATENT DOCUMENTS

| | | | |
|---|---|---|---|
| GB | 2297825 | A | 8/1996 |
| JP | 2002528693 | | 9/2002 |
| JP | 2009504838 | | 2/2009 |
| JP | 2013036676 | | 2/2013 |
| WO | 2009137168 | A2 | 11/2009 |
| WO | 2010040935 | A2 | 4/2010 |
| WO | 2013087569 | | 6/2013 |
| WO | 2013087570 | A2 | 6/2013 |

OTHER PUBLICATIONS

Vovard, Sylvain, Nitrogen Removal on LNG Plant—Select the Optimum Scheme, Gas Processors Association—Europe.
Spring Conference May 25 to 27, 2011, Impurities in Gas Processing—How to remove what you don't want, Copenhagen, Gas Processors Association—Europe.

* cited by examiner

INTEGRATED NITROGEN REMOVAL IN THE PRODUCTION OF LIQUEFIED NATURAL GAS USING REFRIGERATED HEAT PUMP

BACKGROUND

The present invention relates to a method for liquefying a natural gas feed stream and removing nitrogen therefrom. The present invention also relates to an apparatus (such as for example a natural gas liquefaction plant or other form of processing facility) for liquefying a natural gas feed stream and removing nitrogen therefrom.

In processes for liquefying natural gas it is often desirable or necessary, for example due to purity and/or recovery requirements, to remove nitrogen from the feed stream while minimizing product (methane) loss. The removed nitrogen product may be used as fuel gas or vented to atmosphere. If used as fuel gas, the nitrogen product must contain a fair amount of methane (typically >30 mol %) to maintain its heating value. In this case, the separation of nitrogen is not as difficult due to loose specifications on the purity of the nitrogen product, and the objective there is to select the most efficient process with minimal additional equipment and power consumption. In many small and mid-scale liquefied natural gas (LNG) facilities that are driven by electric motors, however, there is very little demand for fuel gas and the nitrogen product has to be vented to the atmosphere. If vented, the nitrogen product has to meet strict purity specifications (e.g., >95 mol %, or >99 mol %), due to environmental concerns and/or due to methane recovery requirements. This purity requirement poses separation challenges. In the case of a very high nitrogen concentration (typically greater than 10 mol %, in some cases up to or even higher than 20 mol %) in the natural gas feed, a dedicated nitrogen rejection unit (NRU) proves to be a robust method to remove nitrogen efficiently and produce a pure (>99 mol %) nitrogen product. In most cases, however, natural gas contains about 1 to 10 mol % nitrogen. When the nitrogen concentration in the feed is within this range, the applicability of the NRU is hindered by the high capital cost due to complexity associated with the additional equipment. A number of prior art documents have proposed alternative solutions to remove nitrogen from natural gas, including adding a nitrogen recycle stream to the NRU or using a dedicated rectifier column. However, these processes often are very complicated, necessitate a large amount of equipment (with associated capital costs), are difficult to operate and/or are inefficient, especially for feed streams of lower nitrogen concentrations (<5 mol %). Furthermore, it is often the case that the nitrogen concentration in a natural gas feed will change from time to time, which means that even if one is dealing with a feed that is currently high in nitrogen content, one cannot guarantee that this will remain the case. It would therefore be desirable to develop a process that is simple, efficient, and capable of removing nitrogen effectively from natural gas feeds with low nitrogen concentrations.

U.S. Pat. No. 3,721,099 discloses a process for liquefying natural gas and separating nitrogen from the liquefied natural gas by rectification. In this process, the natural gas feed is precooled and partially liquefied in a series of heat exchanger units and separated in a phase separator into liquid and vapor phases. The natural gas vapor stream is then liquefied and subcooled in a pipe-coil in the bottom of the double rectification column, providing boilup duty to the high pressure column. The liquid natural gas streams from the pipe-coil is then further subcooled in a heat exchanger unit, expanded in an expansion valve and introduced into and separated in the high pressure column. The methane-rich liquid stream drawn from the bottom of the high-pressure rectification column and the methane-rich liquid stream obtained from the phase separator are subcooled in further heat exchanger units, expanded through expansion valves, and introduced into and separated into the low pressure column. Reflux to the low pressure column is provided by a liquid nitrogen stream obtained from liquefying in a heat exchanger unit a nitrogen stream obtained the top part of the high pressure column. Nitrogen-depleted LNG (predominately liquid methane) product, containing about 0.5% nitrogen, is obtained from the bottom of the low-pressure column and sent to an LNG storage tank. Nitrogen-rich streams are obtained from the top of the low pressure column (containing about 95 mole % nitrogen) and from the top of the high pressure column. The nitrogen-rich streams and boil-off gas from the LNG tank are warmed in the various heat exchanger units to provide refrigeration therefor.

U.S. Pat. No. 7,520,143 discloses a process in which a nitrogen vent stream containing 98 mole % nitrogen is separated by a nitrogen-rejection column. A natural gas feed stream is liquefied in a first (warm) section of a main heat exchanger to produce an LNG stream that is withdrawn from an intermediate location of the heat exchanger, expanded in an expansion valve, and sent to the bottom of the nitrogen-rejection column. The bottom liquid from the nitrogen-rejection column is subcooled in a second (cold) section of the main heat exchanger and expanded through a valve into a flash drum to provide a nitrogen-depleted LNG product (less than 1.5 mole % nitrogen), and a nitrogen-enriched stream which is of lower purity (30 mole % nitrogen) than the nitrogen vent stream and that is used for fuel gas. The overhead vapor from the nitrogen-rejection column is divided, with part of the vapor being withdrawn as the nitrogen vent stream and the remainder being condensed in a heat exchanger in the flash drum to provide reflux to the nitrogen-rejection column. Refrigeration for the main heat exchanger is provided by a closed loop refrigeration system employing a mixed refrigerant.

US 2011/0041389 discloses a process, somewhat similar to that described in U.S. Pat. No. 7,520,143, in which a high purity nitrogen vent stream (typically 90-100% by volume nitrogen) is separated from the natural gas feed stream in a rectification column. The natural gas feed stream is cooled in a warm section of a main heat exchanger to produce a cooled natural gas stream. A portion of this stream is withdrawn from a first intermediate location of the main heat exchanger, expanded and sent to the bottom of the rectification column as stripping gas. The remainder of the stream is further cooled and liquefied in an intermediate section of the main heat exchanger to from an LNG stream that is withdrawn from a second (colder) intermediate location of the heat exchanger, expanded and sent to an intermediate location of the rectification column. The bottom liquid from the rectification column is withdrawn as a nitrogen-depleted LNG stream, subcooled in a cold section of the main heat exchanger and expanded into a phase separator to provide a nitrogen-depleted LNG product, and a nitrogen-enriched stream which is compressed and recycled back into the natural gas feed stream. The overhead vapor from the rectification column is divided, with part of the vapor being withdrawn as the high purity nitrogen vent stream and the remainder being condensed in a heat exchanger in the phase separator to provide reflux to the rectification column.

IPCOM000222164D, a document on the ip.com database, discloses a process in which a stand-alone nitrogen rejection unit (NRU) is used to produce a nitrogen-depleted natural gas stream and a pure nitrogen vent stream. The natural gas feed stream is cooled and partially liquefied in a warm heat exchanger unit and separated in a phase separator into natural gas vapor and liquid streams. The vapor stream is liquefied in cold heat exchanger unit and sent to the top or to an intermediate location of a distillation column. The liquid stream is further cooled in the cold heat exchanger unit, separately from and in parallel with the vapor stream, and is then sent to an intermediate location of the distillation column (below the location at which the vapor stream is introduced). Boil-up for the distillation column is provided by warming and vaporizing a portion of the nitrogen-depleted bottoms liquid from the distillation column in the cold heat exchanger unit, thereby providing also refrigeration for unit. The remainder of the nitrogen-depleted bottoms liquid is pumped to and warmed and vaporized in the warm heat exchanger unit, thereby providing refrigeration for that unit, and leaves the warm exchanger as a fully vaporized vapor stream. The nitrogen enriched overhead vapor withdrawn from the distillation column is warmed in the cold and warm heat exchanger units to provide further refrigeration to said units. Where the vapor stream is introduced into an intermediate location of the distillation column, additional reflux for the column may be provided by condensing a portion of the overhead vapor and returning this to column. This may be done by warming the overhead vapor in an economizer heat exchanger, dividing the warmed overhead vapor, and condensing a portion of the warmed overhead vapor in the economizer heat exchanger and returning the condensed portion to the top of the distillation column. No external refrigeration is used in this process.

US2011/0289963 discloses a process in which nitrogen stripping column is used to separate nitrogen from a natural gas stream. In this process, a natural gas feed stream is cooled and partially liquefied in a warm section of a main heat exchanger via heat exchange with a single mixed refrigerant. The partially condensed natural gas is withdrawn from the main heat exchanger and separated in a phase separator or distillation vessel into natural gas vapor and liquid streams. The liquid stream is further cooled in a cold section of the main heat exchanger before being expanded and introduced into a nitrogen stripping column. A nitrogen-depleted LNG product (containing 1 to 3 volume % nitrogen) is withdrawn from the bottom of the stripping column and a nitrogen-enriched vapor stream (containing less than 10 volume methane) is withdrawn from the top of the stripping column. The natural gas vapor stream from the phase separator or distillation vessel is expanded and cooled in separate heat exchangers and introduced into the top of the stripping column to provide reflux. Refrigeration to the additional heat exchangers is provided by vaporizing a portion of the bottoms liquid from the stripping column (thereby providing also boil-up from the column) and by warming the nitrogen-enriched vapor stream withdrawn from the top of the stripping column.

U.S. Pat. No. 8,522,574 discloses another process in which nitrogen is removed from liquefied natural gas. In this process, a natural gas feed stream is first cooled and liquefied in a main heat exchanger. The liquid stream is then cooled in a secondary heat exchanger and expanded into a flash vessel where a nitrogen-rich vapor is separated from a methane-rich liquid. The vapor stream is further expanded and sent to the top of a fractionation column. The liquid stream from the flash vessel is divided, with one portion being introducing into an intermediate location of the fractionation column, and another portion being warmed in the secondary heat exchanger and introduced into the bottom of the fractionation column. The nitrogen-rich overhead vapor obtained from the fractionation column is passed through and warmed in the secondary heat exchanger to provide additional refrigeration to said heat exchanger. Product liquefied natural gas is recovered from the bottom of the fractionation column.

US2012/019883 discloses a process for liquefying a natural gas stream and removing nitrogen from it. The natural gas feed stream is liquefied in a main heat exchanger, expanded and introduced into the bottom of a separating column. Refrigeration for the main heat exchanger is provided by a closed-loop refrigeration system circulating a mixed refrigerant. Nitrogen-depleted LNG withdrawn from the bottom of the separating column is expanded and further separated in a phase separator. The nitrogen-depleted LNG from the phase separator is sent to an LNG storage tank. The vapor stream from the phase separator is combined with boil off gas from the LNG storage tank, warmed in the main heat exchanger to provide additional refrigeration to the main heat exchanger, compressed, and recycled into the natural gas feed stream. The nitrogen-enriched vapor (90 to 100 volume % nitrogen) withdrawn from the top of the separating column is also warmed in the main heat exchanger to provide additional refrigeration to the main heat exchanger.

BRIEF SUMMARY

According to a first aspect of the present invention, there is provided a method for liquefying a natural gas feed stream and removing nitrogen therefrom, the method comprising:

(a) passing a natural gas feed stream through a main heat exchanger to cool the natural gas stream and liquefy all or a portion of said stream, thereby producing a first LNG stream;

(b) withdrawing the first LNG stream from the main heat exchanger;

(c) expanding and partially vaporizing a liquefied or partially liquefied natural gas stream, and introducing said stream into a distillation column in which the stream is separated into vapor and liquid phases, wherein the liquefied or partially liquefied natural gas stream is the first LNG stream, or is an at least partially liquefied nitrogen-enriched natural gas stream formed from separating a nitrogen-enriched natural gas stream from the first LNG stream or from the natural gas feed stream and at least partially liquefying said stream in the main heat exchanger;

(d) forming a nitrogen-rich vapor product from overhead vapor withdrawn from the distillation column;

(e) providing reflux to the distillation column by condensing a portion of the overhead vapor from the distillation column in a condenser heat exchanger; and (f) forming a second LNG stream from bottoms liquid withdrawn from the distillation column;

wherein refrigeration for the main heat exchanger and for the condenser heat exchanger is provided by a closed loop refrigeration system, refrigerant circulated by the closed loop refrigeration system passing through and being warmed in the main heat exchanger and passing through and being warmed in the condenser heat exchanger.

According to a second aspect of the present invention, there is provided an apparatus for liquefying a natural gas feed stream and removing nitrogen therefrom, the apparatus comprising:

a main heat exchanger having a cooling passage for receiving a natural gas feed stream and passing the natural gas feed stream through the heat exchanger to cool the stream and liquefy all or a portion of the stream, so as to produce a first LNG stream;

an expansion device and distillation column, in fluid flow communication with the main heat exchanger, for receiving, expanding and partially vaporizing a liquefied or partially liquefied natural gas stream and separating said stream in the distillation column into vapor and liquid phases, wherein the liquefied or partially liquefied natural gas stream is the first LNG stream, or is an at least partially liquefied nitrogen-enriched natural gas stream formed from separating a nitrogen-enriched natural gas stream from the first LNG stream or from the natural gas feed stream and at least partially liquefying said stream in the main heat exchanger;

a condenser heat exchanger for providing reflux to the distillation column by condensing a portion of the overhead vapor obtained from the distillation column; and a closed loop refrigeration system for providing refrigeration to the main heat exchanger and condenser heat exchanger, refrigerant circulated by the closed loop refrigeration system passing through and being warmed in the main heat exchanger and passing through and being warmed in the condenser heat exchanger.

Preferred aspects of the present invention include the following aspects, numbered #1 to #21:

#1. A method for liquefying a natural gas feed stream and removing nitrogen therefrom, the method comprising:

(a) passing a natural gas feed stream through a main heat exchanger to cool the natural gas stream and liquefy all or a portion of said stream, thereby producing a first LNG stream;

(b) withdrawing the first LNG stream from the main heat exchanger;

(c) expanding and partially vaporizing a liquefied or partially liquefied natural gas stream, and introducing said stream into a distillation column in which the stream is separated into vapor and liquid phases, wherein the liquefied or partially liquefied natural gas stream is the first LNG stream, or is an at least partially liquefied nitrogen-enriched natural gas stream formed from separating a nitrogen-enriched natural gas stream from the first LNG stream or from the natural gas feed stream and at least partially liquefying said stream in the main heat exchanger;

(d) forming a nitrogen-rich vapor product from overhead vapor withdrawn from the distillation column;

(e) providing reflux to the distillation column by condensing a portion of the overhead vapor from the distillation column in a condenser heat exchanger; and (f) forming a second LNG stream from bottoms liquid withdrawn from the distillation column;

wherein refrigeration for the main heat exchanger and for the condenser heat exchanger is provided by a closed loop refrigeration system, refrigerant circulated by the closed loop refrigeration system passing through and being warmed in the main heat exchanger and passing through and being warmed in the condenser heat exchanger.

#2. The method of Aspect #1, wherein the refrigerant that passes through and is warmed in the condenser heat exchanger is then passed through and further warmed in the main heat exchanger.

#3. The method of Aspect #1 or #2, wherein the warmed refrigerant, that is obtained after refrigeration has been provided to the main heat exchanger and to the condenser heat exchanger, is compressed in one or more compressors and cooled in one or more aftercoolers to form compressed refrigerant; the compressed refrigerant is passed through and cooled in the main heat exchanger to form cooled compressed refrigerant that is withdrawn from the main heat exchanger; and the cooled compressed refrigerant is then divided, with part of the refrigerant being expanded and returned directly to the main heat exchanger to pass through and be warmed in the main heat exchanger, and with another part of the refrigerant being expanded and sent to the condenser heat exchanger to pass through and be warmed in the condenser heat exchanger.

#4. The method of any one of Aspects #1 to #3, wherein the refrigerant circulated by the closed loop refrigeration system is a mixed refrigerant.

#5. The method of Aspect #4, wherein the warmed mixed refrigerant, that is obtained after refrigeration has been provided to the main heat exchanger and to the condenser heat exchanger, is compressed, cooled in the main heat exchanger and separated as it is cooled so as to provide a plurality of liquefied or partially liquefied cold refrigerant streams of different compositions, the cold refrigerant stream with the highest concentration of lighter components obtained from the cold end of the main heat exchanger being divided and expanded so as to provide a stream of refrigerant that is warmed in the condenser heat exchanger and a stream of refrigerant that is returned to the cold end of the main heat exchanger to be warmed therein.

#6. The method of any one of Aspects #1 to #5, wherein refrigeration for the condenser heat exchanger is provided both by the closed loop refrigeration system and by warming overhead vapor withdrawn from the distillation column.

#7. The method of Aspect #6, wherein:

step (e) comprises warming overhead vapor withdrawn from the distillation column in the condenser heat exchanger, compressing a first portion of the warmed overhead vapor, cooling and at least partially condensing the compressed portion in the condenser heat exchanger, and expanding and reintroducing the cooled and at least partially condensed portion back into the top of the distillation column; and step (d) comprises forming the nitrogen-rich vapor product from a second portion of the warmed overhead vapor.

#8. The method of any one of Aspects #1 to #7, wherein step (c) comprises expanding and partially vaporizing the first LNG stream and introducing said stream into the distillation column to separate the stream into vapor and liquid phases.

#9. The method of Aspect #8, wherein the method further comprises sending the second LNG stream to an LNG storage tank.

#10. The method of any one of Aspects #1 to #7, wherein step (c) comprises expanding and partially vaporizing an at least partially liquefied nitrogen-enriched natural gas stream and introducing said stream into the distillation column to separate the stream into vapor and liquid phases, wherein the at least partially liquefied nitrogen-enriched natural gas stream is formed from separating a nitrogen-enriched natural gas stream from the first LNG stream and at least partially liquefying said stream in the main heat exchanger.

#11. The method of Aspect #10, wherein the least partially liquefied nitrogen-enriched natural gas stream is formed by (i) expanding, partially vaporizing and separating the first LNG stream, or an LNG stream formed from part of the first LNG stream, to form a nitrogen-depleted LNG product and a recycle stream composed of nitrogen-enriched natural gas vapor, (ii) compressing the recycle stream to form a compressed recycle stream, and (iii) passing the compressed recycle stream through the main heat exchanger, separately from and in parallel with the natural gas feed stream, to cool the compressed recycle stream and at least partially liquefy all or a portion thereof, thereby producing the at least partially liquefied nitrogen-enriched natural gas stream.

#12. The method of Aspect #11, wherein the first LNG stream, or the LNG stream formed from part of the first LNG stream, is expanded and transferred into an LNG storage tank in which a portion of the LNG vaporizes, thereby forming a nitrogen-enriched natural gas vapor and the nitrogen-depleted LNG product, and nitrogen-enriched natural gas vapor is withdrawn from the tank to form the recycle stream.

#13. The method of Aspect #11 or #12, wherein the method further comprises expanding, partially vaporizing and separating the second LNG stream to produce additional nitrogen-enriched natural gas vapor for the recycle stream and additional nitrogen-depleted LNG product.

#14. The method of any one of Aspects #1 to #7, wherein step (c) comprises expanding and partially vaporizing an at least partially liquefied nitrogen-enriched natural gas stream and introducing said stream into the distillation column to separate the stream into vapor and liquid phases, wherein the at least partially liquefied nitrogen-enriched natural gas stream is formed from separating a nitrogen-enriched natural gas stream from the natural gas feed stream and at least partially liquefying said stream in the main heat exchanger.

#15. The method of Aspect #14, wherein step (a) comprises (i) introducing the natural gas feed stream into the warm end of the main heat exchanger, cooling and at least partially liquefying the natural gas feed stream, and withdrawing the cooled and at least partially liquefied stream from an intermediate location of the main heat exchanger, (ii) expanding, partially vaporizing and separating the cooled and at least partially liquefied stream to form a nitrogen-enriched natural gas vapor stream and a nitrogen-depleted natural gas liquid stream, and (iii) separately re-introducing the vapor and liquid streams into an intermediate location of the main heat exchanger and further cooling the vapor stream and liquid streams in parallel, the liquid stream being further cooled to form the first LNG stream and the vapor stream being further cooled and at least partially liquefied to form the at least partially liquefied nitrogen-enriched natural gas stream.

#16. The method of Aspect #15, wherein the method further comprises:

(g) expanding, partially vaporizing and separating the second LNG stream to form a nitrogen-depleted LNG product and a recycle stream composed of nitrogen-enriched natural gas vapor;

(h) compressing the recycle stream to form a compressed recycle stream; and (i) returning the compressed recycle stream to the main heat exchanger to be cooled and at least partially liquefied in combination with or separately from the natural gas feed stream.

#17. The method of Aspect #16, wherein step (g) comprises expanding the second LNG stream, transferring the expanded stream into an LNG storage tank in which a portion of the LNG vaporizes, thereby forming a nitrogen-enriched natural gas vapor and the nitrogen-depleted LNG product, and withdrawing nitrogen-enriched natural gas vapor from the tank to form the recycle stream.

#18. The method of Aspect #16 or #17, wherein the method further comprises expanding, partially vaporizing and separating the first LNG stream to produce additional nitrogen-enriched natural gas vapor for the recycle stream and additional nitrogen-depleted LNG product.

#19. The method of any one of Aspects #15 to #18, wherein:

step (a)(ii) comprises expanding, partially vaporizing and separating the cooled and at least partially liquefied stream to form the nitrogen-enriched natural gas vapor stream, a stripping gas stream composed of nitrogen-enriched natural gas vapor, and the nitrogen-depleted natural gas liquid stream; and step (c) further comprises introducing the stripping gas stream into the bottom of the distillation column.

#20. The method of any one of Aspects #1 to #19, wherein the liquefied or partially liquefied natural gas stream is introduced into the distillation column at an intermediate location of the column, and boil-up for the distillation column is provided by heating and vaporizing a portion of the bottoms liquid in a reboiler heat exchanger via indirect heat exchange with the liquefied or partially liquefied natural gas stream prior to introduction of said stream into the distillation column.

#21. An apparatus for liquefying a natural gas feed stream and removing nitrogen therefrom, the apparatus comprising:

a main heat exchanger having a cooling passage for receiving a natural gas feed stream and passing the natural gas feed stream through the heat exchanger to cool the stream and liquefy all or a portion of the stream, so as to produce a first LNG stream;

an expansion device and distillation column, in fluid flow communication with the main heat exchanger, for receiving, expanding and partially vaporizing a liquefied or partially liquefied natural gas stream and separating said stream in the distillation column into vapor and liquid phases, wherein the liquefied or partially liquefied natural gas stream is the first LNG stream, or is an at least partially liquefied nitrogen-enriched natural gas stream formed from separating a nitrogen-enriched natural gas stream from the first LNG stream or from the natural gas feed stream and at least partially liquefying said stream in the main heat exchanger;

a condenser heat exchanger for providing reflux to the distillation column by condensing a portion of the overhead vapor obtained from the distillation column; and a closed loop refrigeration system for providing refrigeration to the main heat exchanger and condenser heat exchanger, refrigerant circulated by the closed loop refrigeration system passing through and being warmed in the main heat exchanger and passing through and being warmed in the condenser heat exchanger.

DETAILED DESCRIPTION

Figure 1:
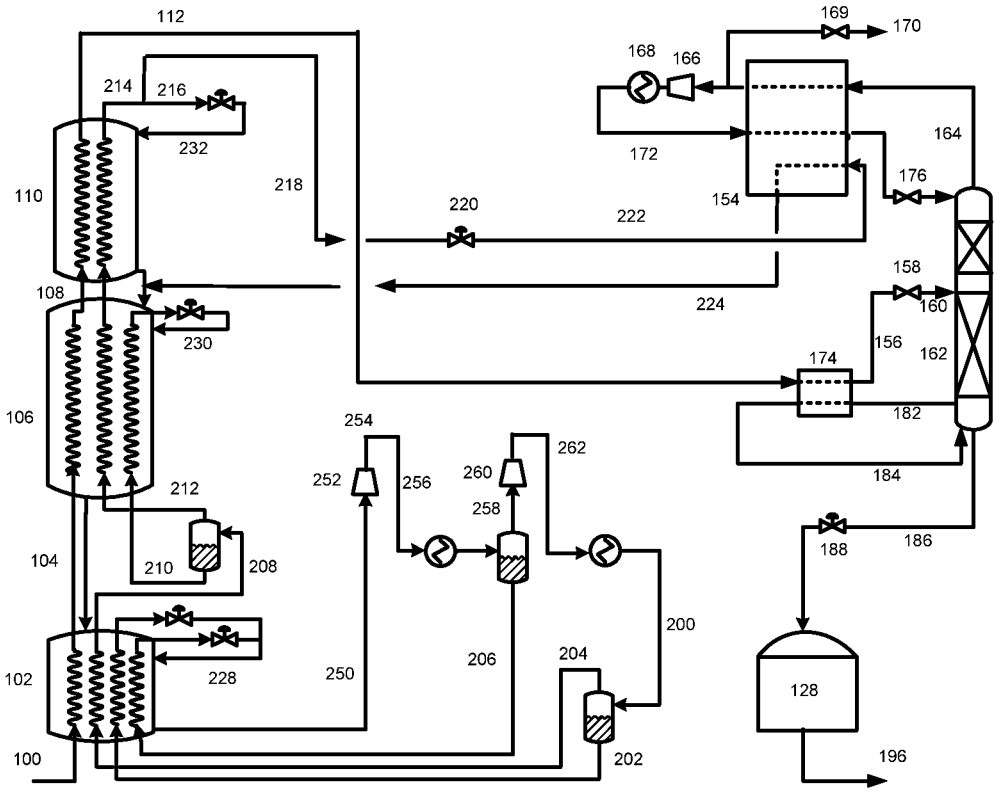
FIG. 1 is a schematic flow diagram depicting a method and apparatus for liquefying and removing nitrogen from a natural gas stream according to one embodiment of the present invention.

Unless otherwise indicated, the articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

As noted above, according to a first aspect of the present invention there is provided a method for liquefying a natural gas feed stream and removing nitrogen therefrom, the method comprising:

(a) passing a natural gas feed stream through a main heat exchanger to cool the natural gas stream and liquefy (and, typically, subcool) all or a portion of said stream, thereby producing a first LNG stream;

(b) withdrawing the first LNG stream from the main heat exchanger;

(c) expanding and partially vaporizing a liquefied or partially liquefied natural gas stream, and introducing said stream into a distillation column in which the stream is separated into vapor and liquid phases, wherein the liquefied or partially liquefied natural gas stream is the first LNG stream, or is an at least partially liquefied nitrogen-enriched natural gas stream formed from separating a nitrogen-enriched natural gas stream from the first LNG stream or from the natural gas feed stream and at least partially liquefying said stream in the main heat exchanger;

(d) forming a nitrogen-rich vapor product from overhead vapor withdrawn from the distillation column;

(e) providing reflux to the distillation column by condensing a portion of the overhead vapor from the distillation column in a condenser heat exchanger; and (f) forming a second LNG stream from bottoms liquid withdrawn from the distillation column;

wherein refrigeration for the main heat exchanger and for the condenser heat exchanger is provided by a closed loop refrigeration system, refrigerant circulated by the closed loop refrigeration system passing through and being warmed in the main heat exchanger and passing through and being warmed in the condenser heat exchanger.

As used herein, the term "natural gas" encompasses also synthetic and substitute natural gases. The natural gas feed stream comprises methane and nitrogen (with methane typically being the major component). Typically the natural gas feed stream has nitrogen concentration of from 1 to 10 mol %, and the methods and apparatus described herein can effectively remove nitrogen from the natural gas feed stream even where the nitrogen concentration in the natural gas feed stream is relatively low, such as 5 mol % or below. The natural gas stream will usual also contain other components, such as for example one or more other hydrocarbons and/or other components such as helium, carbon dioxide, hydrogen, etc. However, it should not contain any additional components at concentrations that will freeze in the main heat exchanger during cooling and liquefaction of the stream. Accordingly, prior to being introduced into the main heat exchanger, the natural gas feed stream may be pretreated if and as necessary to remove water, acid gases, mercury and heavy hydrocarbons from the natural gas feed stream, so as to reduce the concentrations of any such components in the natural gas feed stream down to such levels as will not result in any freezing problems.

As used herein, and unless otherwise indicated, a stream is "nitrogen-enriched" if the concentration of nitrogen in the stream is higher than the concentration of nitrogen in the natural gas feed stream. A stream is "nitrogen-depleted" if the concentration of nitrogen in the stream is lower than the concentration of nitrogen in the natural gas feed stream. In the method according to the first aspect of the present invention as described above, the nitrogen-rich vapor product has a higher nitrogen concentration than the at least partially liquefied nitrogen-enriched natural gas stream (and thus may be described as being further enriched in nitrogen, relative to the natural gas feed stream). Where the natural gas feed stream contains other components in addition to methane and nitrogen, streams that are "nitrogen-enriched" may also be enriched in other light components (e.g. other components having a boiling point similar to or lower than that of nitrogen, such as for example helium), and streams that are "nitrogen-depleted" may also be depleted in other heavy components (e.g. other components having a boiling point similar to or higher than that of methane, such as for example heavier hydrocarbons).

In the methods and apparatus described herein, and unless otherwise indicated, streams may be expanded and/or, in the case of liquid or two-phase streams, expanded and partially vaporized by passing the stream through any suitable expansion device. A stream may, for example, be expanded and partially vaporized by being passed through an expansion valve or J-T valve, or any other device for effecting (essentially) isenthalpic expansion (and hence flash evaporation) of the stream. Additionally or alternatively, a stream may for example be expanded and partially vaporized by being passed and work expanded through a work-extracting device, such as for example a hydraulic turbine or turbo expander, thereby effecting (essentially) isentropic expansion of the stream.

As used herein, the term "distillation column" refers to a column (or set of columns) containing one or more separation sections, each separation section being composed of inserts, such as packing and/or one or more trays, that increase contact and thus enhance mass transfer between the upward rising vapor and downward flowing liquid flowing through the section inside the column. In this way, the concentration of lighter components (such as nitrogen) in the overhead vapor, i.e. the vapor that collects at the top of the column, is increased, and the concentration of heavier components (such as methane) in the bottoms liquid, i.e. the liquid that collects at the bottom of the column, is increased. The "top" of the column refers to the part of the column above the separation sections. The "bottom" of the column refers to the part of the column below the separation sections. An "intermediate location" of the column refers to a location between the top and bottom of the column, typically between two separation sections that are in series.

As used herein, the term "main heat exchanger" refers to the heat exchanger responsible for cooling and liquefying all or a portion of the natural gas stream to produce the first LNG stream. As is described below in more detail, the heat exchanger may be composed of one or more cooling sections arranged in series and/or in parallel. Each such sections may constitute a separate heat exchanger unit having its own housing, but equally sections may be combined into a single heat exchanger unit sharing a common housing. The heat exchanger unit(s) may be of any suitable type, such as but not limited to shell and tube, wound coil, or plate and fin types of heat exchanger unit. In such units, each cooling section will typically comprise its own tube bundle (where the unit is of the shell and tube or wound coil type) or plate and fin bundle (where the unit is of the plate and fin types). As used herein, the "warm end" and "cold end" of the main heat exchanger are relative terms, referring to the ends of the main heat exchanger that are of the highest and lowest temperature (respectively), and are not intended to imply any particular temperature ranges, unless otherwise indicated. The phrase "an intermediate location" of the main heat exchanger refers to a location between the warm and cold ends, typically between two cooling sections that are in series.

As noted above, some or all of the refrigeration for the main heat exchanger and for the condenser heat exchanger is provided by a closed loop refrigeration system, refrigerant circulated by the closed loop refrigeration system passing through and being warmed in the main heat exchanger and passing through and being warmed in the condenser heat exchanger. The closed loop refrigeration system may be of any suitable type. Exemplary refrigeration systems, comprising one or more close loop systems, that may be used in accordance with the present invention include the single mixed refrigerant (SMR) system, the dual mixed refrigerant (DMR) system, the hybrid propane mixed refrigerant (C3MR) system, the nitrogen expansion cycle (or other gaseous expansion cycle) system, and the cascade refrigeration system.

In some embodiments, the refrigerant that passes through and is warmed in the condenser heat exchanger is then passed through and further warmed in the main heat exchanger.

In some embodiments, the warmed refrigerant, that is obtained after refrigeration has been provided to the main heat exchanger and to the condenser heat exchanger, is compressed in one or more compressors and cooled in one or more aftercoolers to form compressed refrigerant; the compressed refrigerant is passed through and cooled in the main heat exchanger to form cooled compressed refrigerant that is withdrawn from the main heat exchanger; and the cooled compressed refrigerant is then divided, with part of the refrigerant being expanded (before and/or after division of the cooled compressed refrigerant) and returned directly to the main heat exchanger to pass through and be warmed in the main heat exchanger, and with another part of the refrigerant being expanded (before and/or after division of the cooled compressed refrigerant) and sent to the condenser heat exchanger to pass through and be warmed in the condenser heat exchanger.

In some embodiments, the refrigerant that is circulated by the closed loop refrigeration system that provides refrigeration for the main heat exchanger and condenser heat exchanger is a mixed refrigerant. The warmed mixed refrigerant, that is obtained after refrigeration has been provided to the main heat exchanger and to the condenser heat exchanger, may be compressed, cooled in the main heat exchanger and separated as it is cooled so as to provide a plurality of liquefied or partially liquefied cold refrigerant streams of different compositions, the cold refrigerant stream with the highest concentration of lighter components obtained from the cold end of the main heat exchanger being then divided and expanded (before or after being divided) so as to provide a stream of refrigerant that is warmed in the condenser heat exchanger and a stream of refrigerant that is returned to the cold end of the main heat exchanger to be warmed therein.

In a preferred embodiment, refrigeration for the condenser heat exchanger is provided both by the closed loop refrigeration system and by warming overhead vapor withdrawn from the distillation column. In this embodiment, step (e) may comprise warming overhead vapor withdrawn from the distillation column in the condenser heat exchanger, compressing a first portion of the warmed overhead vapor, cooling and at least partially condensing the compressed portion in the condenser heat exchanger, and expanding and reintroducing the cooled and at least partially condensed portion back into the top of the distillation column; and step (d) may comprise forming the nitrogen-rich vapor product from a second portion of the warmed overhead vapor.

In one embodiment, step (c) of the method comprises expanding and partially vaporizing the first LNG stream and introducing said stream into the distillation column to separate the stream into vapor and liquid phases. In this embodiment, the second LNG stream is preferable sent to an LNG storage tank.

In another embodiment, step (c) of the method comprises expanding and partially vaporizing an at least partially liquefied nitrogen-enriched natural gas stream and introducing said stream into the distillation column to separate the stream into vapor and liquid phases, wherein the at least partially liquefied nitrogen-enriched natural gas stream is formed from separating a nitrogen-enriched natural gas stream from the first LNG stream and at least partially liquefying said stream in the main heat exchanger.

In this embodiment, the least partially liquefied nitrogen-enriched natural gas stream may be formed by (i) expanding, partially vaporizing and separating the first LNG stream, or an LNG stream formed from part of the first LNG stream, to form a nitrogen-depleted LNG product and a recycle stream composed of nitrogen-enriched natural gas vapor, (ii) compressing the recycle stream to form a compressed recycle stream, and (iii) passing the compressed recycle stream through the main heat exchanger, separately from and in parallel with the natural gas feed stream, to cool the compressed recycle stream and at least partially liquefy all or a portion thereof, thereby producing the at least partially liquefied nitrogen-enriched natural gas stream. Preferably, an LNG storage tank is used to separate the first LNG stream, or LNG stream formed from part of the first LNG stream, to form the nitrogen-depleted LNG product and the recycle stream. Thus, the first LNG stream or the LNG stream formed from part of the first LNG stream may be expanded and transferred into an LNG storage tank in which a portion of the LNG vaporizes, thereby forming a nitrogen-enriched natural gas vapor and the nitrogen-depleted LNG product, and nitrogen-enriched natural gas vapor may then be withdrawn from the tank to form the recycle stream.

In the embodiment described in the paragraph above, the method may further comprise also expanding, partially vaporizing and separating the second LNG stream to produce additional nitrogen-enriched natural gas vapor for the recycle stream and additional nitrogen-depleted LNG product. In this and other embodiments where both the first LNG stream and the second LNG stream are expanded, partially vaporized and separated to produce nitrogen-enriched natural gas vapor for the recycle stream and nitrogen-depleted LNG product, this may be carried out by combining the first and second LNG streams and then expanding, partially vaporizing and separating the combined stream; by separately expanding and partially vaporizing the streams, combining the expanded streams, and then separating the combined stream; or by expanding, partially vaporizing and separating each stream individually.

In another embodiment, step (c) of the method comprises expanding and partially vaporizing an at least partially liquefied nitrogen-enriched natural gas stream and introducing said stream into the distillation column to separate the stream into vapor and liquid phases, wherein the at least partially liquefied nitrogen-enriched natural gas stream is formed from separating a nitrogen-enriched natural gas stream from the natural gas feed stream and at least partially liquefying said stream in the main heat exchanger.

In this embodiment, step (a) of the method may comprise (i) introducing the natural gas feed stream into the warm end of the main heat exchanger, cooling and at least partially liquefying the natural gas feed stream, and withdrawing the cooled and at least partially liquefied stream from an intermediate location of the main heat exchanger, (ii) expanding, partially vaporizing and separating the cooled and at least partially liquefied stream to form a nitrogen-enriched natural gas vapor stream and a nitrogen-depleted natural gas liquid stream, and (iii) separately re-introducing the vapor and liquid streams into an intermediate location of the main heat exchanger and further cooling the vapor stream and liquid streams in parallel, the liquid stream being further cooled to form the first LNG stream and the vapor stream being further cooled and at least partially liquefied to form the at least partially liquefied nitrogen-enriched natural gas stream.

In the embodiment described in the paragraph above, the method may further comprise: (g) expanding, partially vaporizing and separating the second LNG stream to form a nitrogen-depleted LNG product and a recycle stream composed of nitrogen-enriched natural gas vapor; (h) compressing the recycle stream to form a compressed recycle stream; and (i) returning the compressed recycle stream to the main heat exchanger to be cooled and at least partially liquefied in combination with or separately from the natural gas feed stream. The method may further comprises expanding, partially vaporizing and separating the first LNG stream to produce additional nitrogen-enriched natural gas vapor for the recycle stream and additional nitrogen-depleted LNG product. Again, preferably an LNG storage tank is used to separate the second and/or first LNG streams to form the nitrogen-depleted LNG product and a recycle stream.

Step (a)(ii) of the method may further comprise expanding, partially vaporizing and separating the cooled and at least partially liquefied stream to form the nitrogen-enriched natural gas vapor stream, a stripping gas stream composed of nitrogen-enriched natural gas vapor, and the nitrogen-depleted natural gas liquid stream. Step (c) may then further comprise introducing the stripping gas stream into the bottom of the distillation column.

The liquefied or partially liquefied natural gas stream may be introduced into the distillation column at an intermediate location of the column, and boil-up for the distillation column may be provided by heating and vaporizing a portion of the bottoms liquid in a reboiler heat exchanger via indirect heat exchange with the liquefied or partially liquefied natural gas stream prior to introduction of said stream into the distillation column.

As also noted above, according to a second aspect of the present invention there is provided an apparatus for liquefying a natural gas feed stream and removing nitrogen therefrom, the apparatus comprising:

a main heat exchanger having a cooling passage for receiving a natural gas feed stream and passing the natural gas feed stream through the heat exchanger to cool the stream and liquefy all or a portion of the stream, so as to produce a first LNG stream;

an expansion device and distillation column, in fluid flow communication with the main heat exchanger, for receiving, expanding and partially vaporizing a liquefied or partially liquefied natural gas stream and separating said stream in the distillation column into vapor and liquid phases, wherein the liquefied or partially liquefied natural gas stream is the first LNG stream, or is an at least partially liquefied nitrogen-enriched natural gas stream formed from separating a nitrogen-enriched natural gas stream from the first LNG stream or from the natural gas feed stream and at least partially liquefying said stream in the main heat exchanger;

a condenser heat exchanger for providing reflux to the distillation column by condensing a portion of the overhead vapor obtained from the distillation column; and a closed loop refrigeration system for providing refrigeration to the main heat exchanger and condenser heat exchanger, refrigerant circulated by the closed loop refrigeration system passing through and being warmed in the main heat exchanger and passing through and being warmed in the condenser heat exchanger.

As used herein, the term "fluid flow communication" indicates that the devices or systems in question are connected to each other in such a way that the streams that are referred to can be sent and received by the devices or systems in question. The devices or systems may, for example be connected, by suitable tubes, passages or other forms of conduit for transferring the streams in question.

The apparatus according to the second aspect of the invention is suitable for carrying out a method in accordance with the first aspect of the invention. Thus, various preferred or optional features and embodiments of apparatus in accordance with the second aspect will be apparent from the preceding discussion of the various preferred or optional embodiments and features of the method in accordance with the first aspect.

Solely by way of example, various preferred embodiments of the invention will now be described with reference to FIGS. 1 to 4. In these Figures, where a feature is common to more than one Figure that feature has been assigned the same reference numeral in each Figure, for clarity and brevity.

Referring to FIG. 1, a method and apparatus for liquefying and removing nitrogen a natural gas stream according to one embodiment of the present invention is shown.

Natural gas feed stream 100 is first passed through a set of cooling passages in a main heat exchanger to cool, liquefy and (typically) sub-cool the natural gas feed stream, thereby producing a first LNG stream 112, as will be described in further detail below. The natural gas feed stream comprises methane and nitrogen. Typically the natural gas feed stream has a nitrogen concentration of from 1 to 10 mol %, and the methods and apparatus described herein can effectively remove nitrogen from the natural gas even where the nitrogen concentration in the natural gas feed stream is relatively low, such as 5 mol % or below. As is well known in the art, the natural gas feed stream should not contain any additional components at concentrations that will freeze in the main heat exchanger during cooling and liquefaction of the stream. Accordingly, prior to being introduced into the main heat exchanger, the natural gas feed stream may be pretreated if and as necessary to remove water, acid gases, mercury and heavy hydrocarbons from the natural gas feed stream, so as to reduce the concentrations of any such components in the natural gas feed stream down to such levels as will not result in any freezing problems. Appropriate equipment and techniques for effecting dehydration, acid-gas removal, mercury removal and heavy hydrocarbon removal are well known. The natural gas stream must also be at above-ambient pressure, and thus may be compressed and cooled if and as necessary in one or more compressors and aftercoolers (not shown) prior to being introduced into the main heat exchanger.

In the embodiment depicted in FIG. 1, the main heat exchanger is composed of three cooling sections in series, namely, a warm section 102 in which the natural gas feed stream 100 is pre-cooled, a middle or intermediate section 106 in which the cooled natural gas feed stream 104 is liquefied, and a cold section 110 in which the liquefied natural gas feed stream 108 is sub-cooled, the end of warm section 102 into which the natural gas feed stream 100 is introduced therefore constituting the warm end of the main heat exchanger, and the end of the cold section 110 from which the first LNG stream 112 is withdrawn therefore constituting the cold end of the main heat exchanger. As will be recognized, the terms 'warm' and 'cold' in this context refer only to the relative temperatures inside the cooling sections, and do not imply any particular temperature ranges. In the arrangement depicted FIG. 1, each of these sections constitutes a separate heat exchanger unit having its own shell, casing or other form of housing, but equally two or all three of the sections could be combined into a single heat exchanger unit sharing a common housing. The heat exchanger unit(s) may be of any suitable type, such as but not limited to shell and tube, wound coil, or plate and fin types of heat exchanger unit. In such units, each cooling section will typically comprise its own tube bundle (where the unit is of the shell and tube or wound coil type) or plate and fin bundle (where the unit is of the plate and fin types).

In the embodiment depicted in FIG. 1, the first (sub-cooled) LNG stream 112 withdrawn from the cold end of the main heat exchanger is then expanded, partially vaporized and introduced into a distillation column 162 in which the stream is separated into vapor and liquid phases to form a nitrogen rich vapor product 170 and a second (nitrogen depleted) LNG stream 186.

The distillation column 162 in this embodiment comprises two separation sections, each composed of inserts such as packing and/or one or more trays that increase contact and thus enhances mass transfer between the upward rising vapor and downward flowing liquid inside the column. The first LNG stream 112 is cooled in a reboiler heat exchanger 174 forming a cooled stream 156 that is then expanded and partially vaporized by being passed through an expansion device, such as for example through a J-T valve 158 or a work-extracting device (e.g. hydraulic turbine or turbo expander (not shown)), forming an expanded and partially vaporized stream 160 that is introduced into and intermediate location of the distillation column, between the separation sections, for separation into vapor and liquid phases. The bottoms liquid from the distillation column 162 is depleted in nitrogen (relative to the first LNG stream 112 and natural gas feed stream 100). The overhead vapor from the distillation column 162 is enriched in nitrogen (relative to the first LNG stream 112 and natural gas feed stream 100).

Boil-up for the distillation column 162 is provided by warming and at least partially vaporizing a stream 182 of bottoms liquid from the column in the reboiler heat exchanger 174 and returning the warmed and at least partially vaporized stream 184 to the bottom of the column thereby providing stripping gas to the column. The remainder of the bottoms liquid not vaporized in the reboiler heat exchanger 174 is withdrawn from the distillation column 162 to form the second LNG stream 186. In the depicted embodiment, the second LNG stream 186 is then further expanded, for example by passing the stream through an expansion device such as a J-T valve 188 or turbo-expander (not shown), to form an expanded LNG stream that is introduced into an LNG storage tank 144, from which nitrogen-depleted LNG product 196 may be withdrawn.

Reflux for the distillation column 162 is provided by condensing a portion of the overhead vapor 164 from the distillation column in a condenser heat exchanger 154. The remainder of the overhead vapor that is not condensed in the condenser heat exchanger 154 is withdrawn from the distillation column 162 to form the nitrogen-rich vapor product 170. Refrigeration for the condenser heat exchanger 154 is provided by a closed loop refrigeration system that also provides refrigeration for the main heat exchanger. In the embodiment depicted in FIG. 1, some of the refrigeration for the condenser heat exchanger 154 is also provided by the cold overhead vapor 164 itself.

More specifically, the cold overhead vapor 164 withdrawn from the top of the distillation column 162 is first warmed in condenser heat exchanger 154. A portion of the warmed overhead is then compressed in compressor 166, cooled in aftercooler 168 (using coolant such as, for example, air or water at ambient temperature), further cooled and at least partially liquefied in condenser heat exchanger 154, expanded, for example through expansion device such as a J-T valve 176 or turbo-expander (not shown), and returned to the top of distillation column 162 thereby providing reflux to the column. The remainder of the warmed overhead, after passing through control valve 169 (which may control the operating pressure of the distillation column 162), forms the nitrogen-rich vapor product stream 170. Additional refrigeration is provided to the condenser heat exchanger 154 by a stream of refrigerant 222 supplied by a closed loop refrigeration system that also provides refrigeration for the main heat exchanger, as will now be described in further detail.

As noted above, some or all of the refrigeration for the main heat exchanger is provided by a closed loop refrigeration system, which may be of any suitable type. Exemplary refrigeration systems that may be used include a single mixed refrigerant (SMR) system, a dual mixed refrigerant (DMR) system, a hybrid propane mixed refrigerant (C3MR) system, and a nitrogen expansion cycle (or other gaseous expansion cycle) system, and a cascade refrigeration system. In the SMR and nitrogen expansion cycle systems, refrigeration is supplied to all three sections 102, 106, 110 of the main heat exchanger by a single mixed refrigerant (in the case of the SMR system) or by nitrogen (in the case of the nitrogen expansion cycle system) circulated by a closed loop refrigeration system. In the DMR and C3MR systems, two separate closed loop refrigeration systems circulating two separate refrigerants (two different mixed refrigerants in the case of the DMR system, and a propane refrigerant and mixed refrigerant in the case of the C3MR system) are used to supply refrigerant to the main heat exchanger, such that different sections of the main heat exchanger may be cooled by different closed loop systems. The operation of SMR, DMR, C3MR, nitrogen expansion cycle and other such closed loop refrigeration systems are well known.

By way of example, in the embodiment depicted in FIG. 1, the refrigeration for the main heat exchanger is provided by a single mixed refrigerant (SMR) system, each of cooling sections 102, 106 and 110 of the main heat exchanger comprising heat exchanger units of the wound coil type. In this type of closed loop system, the mixed refrigerant that is circulated consists of a mixture of components, such as a mixture of nitrogen, methane, ethane, propane, butane and isopentane. Warmed mixed refrigerant 250 exiting the warm end of the main heat exchanger is compressed in compressor 252 to form a compressed stream 256. The compressed stream is then passed through an aftercooler to cool and partly condense the stream, and is then separated in a phase separator into vapor 258 and liquid 206 streams. The vapor stream 258 is further compressed in compressor 260 and cooled and partly condensed to form a high pressure mixed refrigerant stream 200 at ambient temperature. The aftercoolers can use any suitable ambient heat sink, such as air, freshwater, seawater or water from an evaporative cooling tower.

The high pressure mixed refrigerant stream 200 is separated in a phase separator into vapor stream 204 and a liquid stream 202. Liquid streams 202 and 206 are then subcooled in the warm section 102 of the main heat exchanger, before being reduced in pressure and combined to form cold refrigerant stream 228 which is passed through the shell side of the warm section 102 of the main heat exchanger where it is vaporized and warmed to provide refrigeration to said section. Vapor stream 204 is cooled and partly liquefied in the warm section 102 of the main heat exchanger, exiting as stream 208. Stream 208 is then separated in a phase separator into vapor stream 212 and liquid stream 210. Liquid stream 210 is subcooled in the middle section 106 of the main heat exchanger, and then reduced in pressure to form cold refrigerant stream 230 which is passed through the shell side of the middle section 106 of the main heat exchanger where it is vaporized and warmed to provide refrigeration to said section. Vapor stream 212 is condensed and subcooled in the middle 106 and cold 110 sections of the main heat exchanger exiting as stream 214, which stream is then divided into two portions.

The major portion of 216 of refrigerant stream 214 is expanded to provide cold refrigerant stream 232 which is passed through the shell side of the cold section 110 of the main heat exchanger where it is vaporized and warmed to provide refrigeration to said section. The warmed refrigerant (derived from stream 232) exiting the shell side of cold section 110 is combined with refrigerant stream 230 in the shellside of the middle section 106, where it is further warmed and vaporized providing additional refrigerant to that section. The combined warmed refrigerant exiting the shell side of middle section 106 is combined with refrigerant stream 228 in the shell side of warm section 102, where it is further warmed and vaporized providing additional refrigerant to that section. The combined warmed refrigerant exiting the shell side of the warm section 102 has been fully vaporized and preferably superheated by about 5° C., and exits as warmed mixed refrigerant stream 250 thus completing the refrigeration loop.

The other, minor portion 218 (typically less than 20%) of refrigerant stream 214 is used to provide refrigeration to the condenser heat exchanger 154 that, as described above, provides reflux for the distillation column 164, said portion being warmed in the condenser heat exchanger 154 to provide refrigeration thereto before being returned to and further warmed in the main heat exchanger. More specifically, the minor portion 218 of refrigerant stream 214 is expanded, for example by passing the stream through a J-T valve 220 or other suitable form of expansion device (such as for example a turbo-expander), to form cold refrigerant stream 222. Stream 222 is then warmed and at least partly vaporized in the condenser heat exchanger 154 before being returned to the main heat exchanger by being combined with the warmed refrigerant (derived from stream 232) exiting the shell side of the cold section 110 of the main heat exchanger and entering the shell side of the middle section 106 with refrigerant stream 230.

The use of the condenser heat exchanger 154 (and, in particular the use of the nitrogen heat pump cycle involving condenser heat exchanger 154, compressor 166, and aftercooler 168) to make the top of the distillation column 162 colder enables a nitrogen rich product 170 of higher purity to be obtained. The use of the closed loop refrigeration system to provide also refrigeration for the condenser heat exchanger 154 improves the overall efficiency of the process by minimizing the internal temperature differences in the condenser exchanger 154, with the mixed refrigerant providing cooling at the appropriate temperature where the condensation of the recycled nitrogen is occurring.

Figure 4:
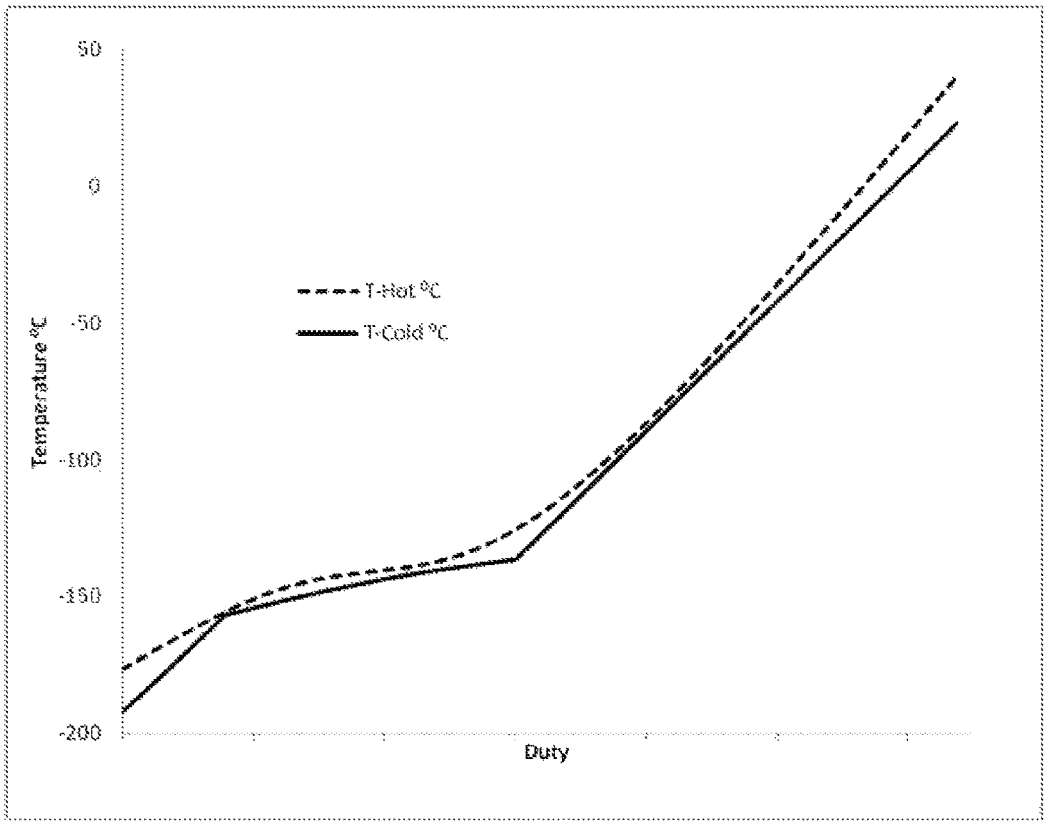
FIG. 4 is a graph showing the cooling curves for the condenser heat exchanger used in the method and apparatus depicted in FIG. 1.

This is illustrated by the cooling curves depicted in FIG. 4 that are obtained for the condenser heat exchanger 154 when operated in accordance with the embodiment depicted in FIG. 1 and as described above. Preferably, the discharge pressure of the compressor 166 is chosen such that the compressed and warmed portion of the overhead vapor 172, that is to be cooled in the condenser heat exchanger 154, condenses at a temperature just above the temperature at which the mixed refrigerant vaporizes. The overhead vapor 164 withdrawn from the distillation column 162 may enter the condenser heat exchanger 154 at its dew point (about −159° C.), and be warmed to near ambient condition. After withdrawal of the nitrogen-rich vapor product 170, the remaining overhead vapor is then compressed in compressor 166, cooled in aftercooler 168 to near ambient temperature and returned to the condenser heat exchanger 154 to be cooled and condensed, providing reflux for the distillation column 162, as previously described.

Figure 2:
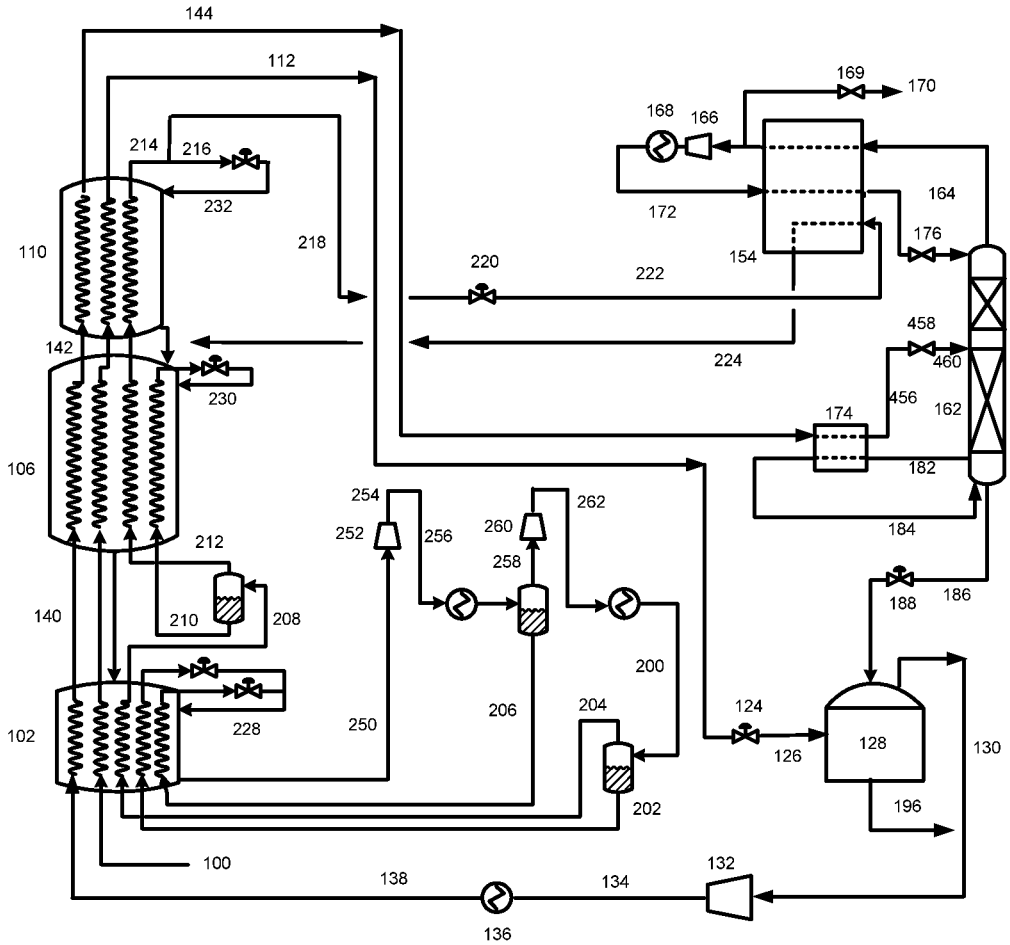
FIG. 2 is a schematic flow diagram depicting a method and apparatus according to another embodiment of the present invention.
Figure 3:
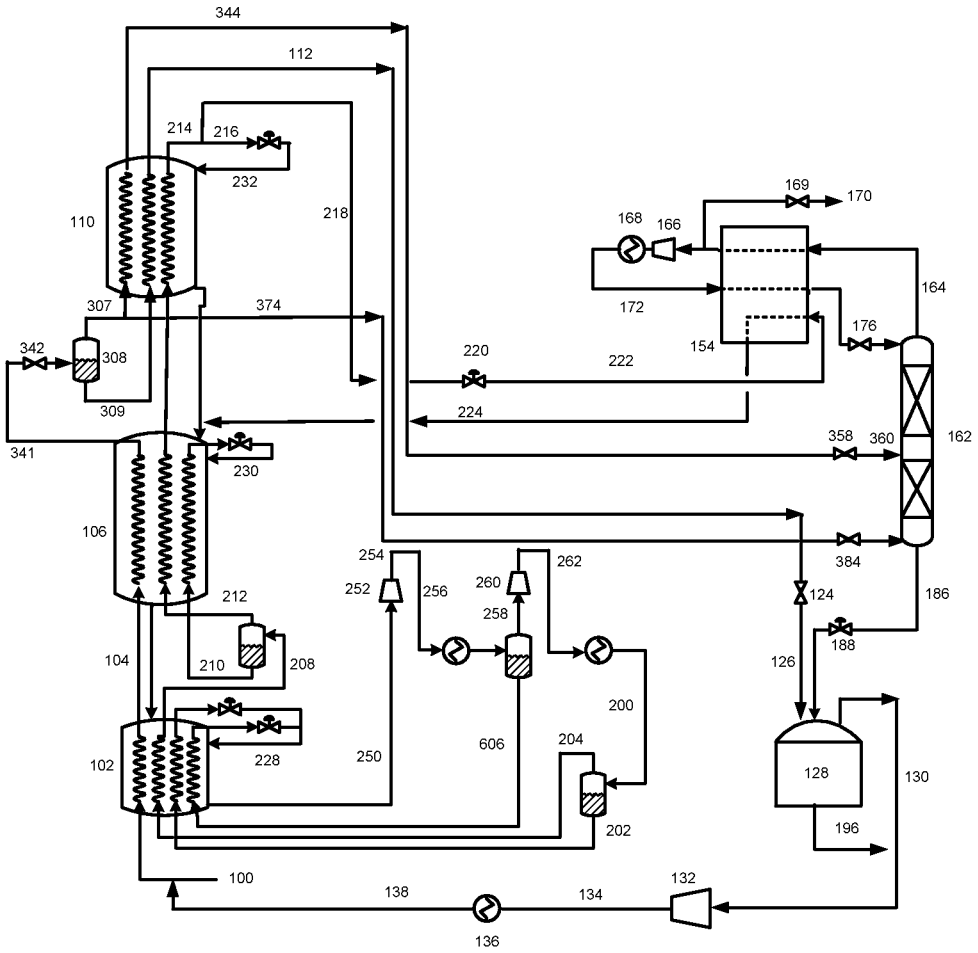
FIG. 3 is a schematic flow diagram depicting a method and apparatus according to another embodiment of the present invention.

Referring now to FIGS. 2 and 3, these depict further methods and apparatus for liquefying and removing nitrogen from a natural gas stream according to alternative embodiments of the present invention. These embodiments differ from the embodiment depicted in FIG. 1 in that in these embodiments the stream that is sent to the distillation column 162 for separation into vapor and liquid phases is not the first LNG stream 112, but rather is instead an at least partially liquefied nitrogen-enriched natural gas stream (144 or 344) obtained from separating a nitrogen-enriched natural gas stream from the first LNG stream or from the natural gas feed stream.

In the method and apparatus depicted in FIG. 2, the at least partially liquefied nitrogen-enriched natural gas stream 144 sent to and separated in the distillation column 162 is formed from separating a nitrogen-enriched natural gas stream 130 from the first LNG stream 112 and at least partially liquefying said stream in the main heat exchanger.

More specifically, the first LNG stream 112 withdrawn from the cold end of the main heat exchanger is expanded, for example by passing the stream through an expansion device such as a J-T valve 124 or turbo-expander (not shown), to form an expanded LNG stream 126 that is introduced into the LNG storage tank 128. Inside the LNG storage tank 128 a portion of the LNG vaporizes, as a result of the initial expansion and introduction of the LNG into the tank and/or as a result ambient heating over time (since the storage tank cannot be perfectly insulated), producing a nitrogen enriched natural gas vapor that collects in and is withdrawn from the headspace of the tank as a recycle stream 130, and leaving behind a nitrogen-depleted LNG product that is stored in the tank and can be withdrawn as product stream 196. In an alternative embodiment (not depicted), LNG storage tank 128 could be replaced with a phase separator (such as a flash drum) or other form of separation device in which the expanded LNG stream 126 is separated into liquid and vapor phases forming, respectively, the nitrogen depleted LNG product 196 and recycle stream 130 composed of nitrogen enriched natural gas vapor. In the case where an LNG storage tank is used, the nitrogen enriched natural gas vapor that collects in and is withdrawn from the headspace of the tank may also be referred to as a tank flash gas (TFG) or boil-off gas (BOG). In the case where a phase separator is used, the nitrogen enriched natural gas vapor that is formed in and withdrawn from the phase separator may also be referred to as an end-flash gas (EFG).

The recycle stream 130 composed of nitrogen enriched natural gas vapor is then recompressed in one or more compressors 132 and cooled in one or more aftercoolers 136 to form a compressed recycle stream 138 that is recycled to the main heat exchanger (hence the reason for this stream being referred to as a recycle stream). The aftercoolers may use any suitable form of coolant, such as for example water or air at ambient temperature. The compressed and cooled nitrogen enriched natural gas vapor exiting aftercooler 136 may also be divided (not shown) with a portion of said gas forming the compressed recycle stream 138 that is sent to the main heat exchanger, and with another portion (not shown) being withdrawn and used for other purposes such as plant fuel demand (not shown). The compressed recycle stream 138, as a result of being cooled in aftercooler(s) 136, is at approximately the same temperature (e.g. ambient) as the natural gas feed stream 100, and is introduced separately into the warm end of the main heat exchanger and is passed through a separate cooling passage or set of cooling passages, that run parallel to the cooling passages in which the natural gas feed stream is cooled, so as to separately cool the compressed recycle stream in the warm, middle and cold sections 102, 106 and 110 of the main heat exchanger, the compressed recycle stream being cooled and at least partially liquefied to form a first at least partially liquefied (i.e. a partially or fully liquefied) nitrogen-enriched natural gas stream 144.

The first at least partially liquefied (i.e. a partially or fully liquefied) nitrogen-enriched natural gas stream 144 withdrawn from the cold end of the main heat exchanger is then expanded, partially vaporized and introduced into a distillation column 162 in which the stream is separated into vapor and liquid phases to form the nitrogen rich vapor product 170 and the second (nitrogen depleted) LNG stream 186, in an analogous manner to the first LNG stream 112 in the embodiment of the invention depicted in FIG. 1 and described above. More specifically, the first at least partially liquefied nitrogen-enriched natural gas stream 144 is cooled in the reboiler heat exchanger 174 forming a cooled stream 456 that is then expanded and partially vaporized, for example by being passed through an expansion device such as a J-T valve 458 or turbo expander (not shown), forming an expanded and partially vaporized stream 460 that is introduced into and intermediate location of the distillation column, between the separation sections, for separation into vapor and liquid phases.

The overhead vapor from the distillation column 162, which in this embodiment is further enriched in nitrogen (i.e. it is enriched in nitrogen relative to the first at least partially liquefied nitrogen-enriched natural gas stream 144, and thus further enriched in nitrogen relative to the natural gas feed stream 100), again provides the nitrogen-rich vapor product 170.

The bottoms liquid from the distillation column 162 again provides a second LNG stream 186, which again is transferred to the LNG storage tank 128. More specifically, the second LNG stream 186 withdrawn from the bottom of the distillation column 162 is then expanded, for example by passing the stream through a J-T valve 188 or turbo-expander (not shown), to form an expanded stream at approximately the same pressure as the expanded first LNG stream 126. The expanded second LNG stream is likewise introduced into the LNG storage tank 128 in which, as described above, a portion of the LNG vaporizes, providing nitrogen enriched natural gas vapor that is withdrawn from the headspace of the tank as recycle stream 130, and leaving behind the nitrogen-depleted LNG product that is stored in the tank and can be withdrawn as product stream 196. Thus, in this embodiment the second LNG stream 186 and the first LNG stream 112 are expanded, combined and together separated into the recycle stream 130 and the LNG product 196. However, in an alternative embodiment (not depicted), the second LNG stream 186 and the first LNG stream 112 could be expanded and introduced into different LNG storage tanks (or other forms of separation system) to produce separate recycle streams that are then combined, and separate LNG product streams. Equally, in yet another embodiment (not depicted), the second LNG stream 186 and the first LNG stream 112 could (if of or adjusted to a similar pressure) be combined prior to being expanded through a J-T valve, turbo-expander or other form of expansion device, and then the combined expanded stream introduced into the LNG storage tank (or other form of separation system).

The embodiment depicted in FIG. 2 provides a simple and efficient means of liquefying natural gas and removing nitrogen to produce both high purity LNG product and a high purity nitrogen stream that can be vented while meeting environmental purity requirements, and without resulting in significant loss of methane. Alternatively, the nitrogen stream 170 can also be used elsewhere such as for fuel if the methane content is high enough. In particular, the recycle stream is enriched in nitrogen compared to the natural gas feed stream and first LNG, and thus by at least partially liquefying the recycle stream (thereby forming the first at least partially liquefied nitrogen-enriched natural gas stream) and then separating this stream in the distillation column instead of the first LNG stream, a nitrogen-rich vapor product of significantly higher purity (i.e. higher nitrogen concentration) is obtained for similar separation stages. Equally, although the recycle stream could be cooled and at least partially liquefied by adding a dedicated heat exchanger and refrigeration system for doing this, using the main heat exchanger and its associated existing refrigeration system to cool and at least partially liquefy the recycle stream, so that this can then be separated into the nitrogen rich product and additional LNG product, provides for a more compact and cost efficient process and apparatus.

In the method and apparatus depicted in FIG. 3, the at least partially liquefied nitrogen-enriched natural gas stream 344 sent to and separated in the distillation column 162 is formed from separating a nitrogen-enriched natural gas stream 307 from the natural gas feed stream 100 and at least partially liquefying said stream in the main heat exchanger.

More specifically, in the embodiment depicted in FIG. 3, the natural gas feed stream 100 is first passed through a set of cooling passages in a main heat exchanger to cool the natural gas stream, to liquefy and (typically) sub-cool a portion thereof thereby producing the first LNG stream 112, and to at least partially liquefy another portion thereof thereby producing the first at least partially liquefied nitrogen-enriched natural gas stream 344. The natural gas feed stream 100 is introduced into the warm end of the main heat exchanger and passes through a first cooling passage running through the warm 102 and middle 106 sections of the main heat exchanger, in which the stream is cooled and at least partially liquefied, thereby producing a cooled and at least partially liquefied natural gas stream 341. The cooled and at least partially liquefied natural gas stream 341 is then withdrawn from an intermediate location of the main heat exchanger, between the middle and cold sections of the main heat exchanger, and expanded, partially vaporized an separated in a separation system, composed of a expansion device, such as a J-T valve 342 or work-extracting device (e.g. hydraulic turbine or turbo expander (not shown)), and phase separator 308 (such as a flash drum), to form a nitrogen-enriched natural gas vapor stream 307 and a nitrogen-depleted natural gas liquid stream 309. The vapor 307 and liquid 309 streams are then separately re-introduced into an intermediate location of the main heat exchanger, between the middle 106 and cold 110 sections. The liquid stream 309 is passed through a second cooling passage, running through the cold section 110 of the main heat exchanger, in which the stream is subcooled to form the first (sub-cooled) LNG stream 112. The vapor stream 307 is passed through a third cooling passage, that runs through the cold section 110 of the main heat exchanger separately from and in parallel with the second cooling passage, in which the stream cooled and at least partially liquefied to form the first at least partially liquefied (i.e. a partially or fully liquefied) nitrogen-enriched natural gas stream 344. The first LNG stream 112 and the first at least partially liquefied nitrogen-enriched natural gas stream 344 are then withdrawn from the cold end of the main heat exchanger.

The first at least partially liquefied nitrogen-enriched natural gas stream 344 is then, in a similar manner to the first LNG stream 112 in the embodiment depicted in FIG. 1, expanded, partially vaporized and introduced the distillation column 162 in which the stream is separated into vapor and liquid phases to form the nitrogen rich vapor product 170 and the second (nitrogen depleted) LNG stream 186. However, in the embodiment depicted in FIG. 3 no reboiler heat exchanger is used to provide boil up to the distillation column 162. Thus, the first at least partially liquefied nitrogen-enriched natural gas stream 344 is simply expanded and partially vaporized, for example by being passed through an expansion device such as a J-T valve 358 or turbo expander (not shown), forming an expanded and partially vaporized stream 360 that is introduced into and intermediate location of the distillation column, between the separation sections, for separation into vapor and liquid phases. Instead of using a reboiler heat exchanger, stripping gas for the distillation column 162 is provided by a portion 374 of the nitrogen-enriched natural gas vapor obtained from phase separator 308. More specifically, the nitrogen-enriched natural gas vapor produced by the phase separator 308 is divided to produce two nitrogen-enriched natural gas vapor streams 307, 374. Alternately, the reboiler for this embodiment could be provided in the same manner as depicted for FIGS. 1 and 2. Likewise, the stripping vapor in FIGS. 1 and 2 could be obtained from warm natural gas from between the middle and cold bundles as shown in FIG. 3, or from the warm end or any other intermediate location of the liquefaction unit (not shown). Stream 307 is passed through and further cooled in the cold section 110 of the main heat exchanger to form the first at least partially liquefied nitrogen-enriched natural gas stream 344 as described above. Stream 374 is expanded, for example by being passed through a J-T valve 384 or turbo expander (not shown), and introduced as a stripping gas stream into the bottom of the distillation column 162.

As in the embodiment depicted in FIG. 2, the first LNG stream 112 withdrawn from the cold end of the main heat exchanger is (along with the second LNG stream 186) again expanded and sent to the LNG storage tank 128 (or other separation device) to provide the nitrogen-depleted LNG product 196 and recycle stream 130 composed of nitrogen-enriched natural gas vapor. However, in the embodiment depicted in FIG. 3, the compressed recycle stream 138, formed from compressing the recycle stream in compressor 132 and cooling the compressed recycle stream 134 in the aftercooler 136, is recycled back to the main heat exchanger by being introduced back into the natural gas feed stream 100 so that it is cooled and at least partially liquefied in the main heat exchanger in combination with and as part of the natural gas feed stream.

As with the embodiment depicted and described in FIG. 2, the embodiment depicted in FIG. 3 provides a method and apparatus that has a relatively low equipment count, is efficient, simple and easy to operate, and allows the production of both high purity LNG product and a high purity nitrogen streams even with natural gas feed compositions of relatively low nitrogen concentration. By separating a first at least partially liquefied nitrogen-enriched natural gas stream in the distillation column instead of the first LNG stream, a nitrogen-rich vapor product of significantly higher purity is obtained, and by using the main heat exchanger and its associated refrigeration system to generate said first at least partially liquefied nitrogen-enriched natural gas stream, rather than adding a dedicated heat exchanger and refrigeration system for doing this, a more compact and cost efficient process and apparatus is provided.

EXAMPLE

In order to illustrate the operation of the invention, the process described and depicted in FIG. 5 (using SMR refrigeration process) was followed, in order to obtain a nitrogen vent stream with 1% methane and a liquefied natural gas product with 1% nitrogen. The natural gas feed composition is shown in Table 1, and Table 2 lists the compositions of the primary streams. The data was generated using ASPEN Plus software. As can be seen from the data, the process effectively removes nitrogen from the liquefied natural gas stream.

TABLE 1

| Natural Gas Feed Process Conditions and Compositions | |
|---|---|
| Temperature (° F.) | 100 |
| Pressure (psia) | 870 |
| Flowrate (lbmol/hr) | 5500 |
| Component (mol %) | |
| $N_2$ | 3 |
| $C_1$ | 96.48 |
| $C_2$ | 0.5 |
| $C_3$ | 0.02 |

TABLE 2

| Stream Conditions and Compositions | | | | | | | | |
|---|---|---|---|---|---|---|---|---|
| | 112 | 160 | 164 | 170 | 218 | 224 | 108 | 196 |
| Mole Fraction % | | | | | | | | |
| $N_2$ | 3 | 3 | 99 | 99 | 16.5 | 16.5 | 3 | 0.4 |
| C1 | 96.6 | 96.6 | 1 | 1 | 56.5 | 56.5 | 96.6 | 99.1 |
| C2 | 0.4 | .4 | 0 | 0 | 0.5 | 0.5 | .4 | 0.5 |
| C3 | .02 | .02 | 0 | 0 | 1.9 | 1.9 | .02 | 0 |
| EL | 0 | 0 | 0 | 0 | 24.5 | 24.5 | 0 | 0 |
| Temperature (° F.) | −244 | −256 | −314 | 73.4 | −244 | −214 | −180 | −260 |
| Pressure (psia) | 223 | 223 | 18 | 15 | 445 | 76 | 283 | 15 |
| Vapor Fraction | 0 | 0 | 1 | 1 | 0 | 0.4 | 0 | 0 |
| Total Flow (lbmol/hr) | 5883 | 5883 | 599 | 123 | 442 | 442 | 5883 | 5356 |

It will be appreciated that the invention is not restricted to the details described above with reference to the preferred embodiments but that numerous modifications and variations can be made without departing from the spirit or scope of the invention as defined in the following claims.

The invention claimed is:

1. A method for liquefying a natural gas feed stream and removing nitrogen therefrom, the method comprising:

(a) passing a natural gas feed stream through a main heat exchanger to cool and liquefy all or a portion of the natural gas stream, thereby producing a first LNG stream;

(b) withdrawing the first LNG stream from the main heat exchanger;

(c) expanding and partially vaporizing the first LNG stream, and introducing the expanded and partially vaporized LNG stream into a distillation column where the expanded and partially vaporized LNG stream is separated into a distillation column overhead vapor product stream and a distillation column liquid product stream, wherein the composition of the distillation column overhead vapor product stream is at least 99% mole fraction nitrogen;

(d1) providing reflux to the distillation column through a nitrogen heat pump by warming the distillation column overhead vapor product stream in a condenser heat exchanger to produce a warmed overhead vapor;

(d2) dividing the warmed overhead vapor into a first portion warmed overhead vapor and a second portion warmed overhead vapor;

(d3) compressing the first portion of the warmed overhead vapor to produce a compressed overhead vapor;

(d4) cooling the compressed overhead vapor in an ambient heat exchanger to produce a cooled compressed overhead stream;

(d5) further cooling and condensing the cooled compressed overhead stream in the condenser heat exchanger against first the distillation column overhead vapor product stream of step (d1) and then subsequently both the distillation column overhead vapor product stream of step (d1) and a closed loop refrigeration system to produce a condensed overhead vapor;

(d6) expanding the condensed overhead vapor and reintroducing the condensed overhead vapor back into the top of the distillation column as reflux stream;

(e) withdrawing the second portion of the warmed overhead vapor to form a nitrogen rich vapor product; and (f) forming a second LNG stream from the distillation column liquid product stream withdrawn from the distillation column;

wherein refrigeration for the main heat exchanger is provided by the closed loop refrigeration system having refrigerant circulated and passing through and being warmed in the main heat exchanger and passing through and being warmed in the condenser heat exchanger.

2. The method of claim 1, wherein the refrigerant that passes through and is warmed in the condenser heat exchanger is then passed through and further warmed in the main heat exchanger.

3. The method of claim 1, wherein the warmed refrigerant, that is obtained after refrigeration has been provided to the main heat exchanger and to the condenser heat exchanger, is compressed in one or more compressors and cooled in one or more aftercoolers to form compressed refrigerant; the compressed refrigerant is passed through and cooled in the main heat exchanger to form cooled compressed refrigerant that is withdrawn from the main heat exchanger; and the cooled compressed refrigerant is then divided, with part of the refrigerant being expanded and returned directly to the main heat exchanger to pass through and be warmed in the main heat exchanger, and with another part of the refrigerant being expanded and sent to the condenser heat exchanger to pass through and be warmed in the condenser heat exchanger.

4. The method of claim 1, wherein the refrigerant circulated by the closed loop refrigeration system is a mixed refrigerant.

5. The method of claim 4, wherein the warmed mixed refrigerant, that is obtained after refrigeration has been provided to the main heat exchanger and to the condenser heat exchanger, is compressed, cooled in the main heat exchanger and separated as it the warmed mixed refrigerant is cooled so as to provide a plurality of liquefied or partially liquefied cold refrigerant streams of different compositions, the cold refrigerant stream with the highest concentration of lighter components obtained from the cold end of the main heat exchanger being divided and expanded so as to provide a stream of refrigerant that is warmed in the condenser heat exchanger and a stream of refrigerant that is returned to the cold end of the main heat exchanger to be warmed therein.

6. The method of claim 1, wherein the method further comprises sending the second LNG stream to an LNG storage tank.

7. The method of claim 1, wherein step (c) comprises expanding and partially vaporizing an at least partially liquefied nitrogen-enriched natural gas stream and introducing said stream into the distillation column to separate the stream into vapor and liquid phases, wherein the at least partially liquefied nitrogen-enriched natural gas stream is formed from separating a nitrogen-enriched natural gas stream from the first LNG stream and at least partially liquefying said stream in the main heat exchanger.

8. The method of claim 7, wherein the least partially liquefied nitrogen-enriched natural gas stream is formed by (i) expanding, partially vaporizing and separating the first LNG stream, or an LNG stream formed from part of the first LNG stream, to form a nitrogen-depleted LNG product and a recycle stream composed of nitrogen-enriched natural gas vapor, (ii) compressing the recycle stream to form a compressed recycle stream, and (iii) passing the compressed recycle stream through the main heat exchanger, separately from and in parallel with the natural gas feed stream, to cool the compressed recycle stream and at least partially liquefy all or a portion thereof, thereby producing the at least partially liquefied nitrogen-enriched natural gas stream.

9. The method of claim 8, wherein the first LNG stream, or the LNG stream formed from part of the first LNG stream, is expanded and transferred into an LNG storage tank in which a portion of the LNG vaporizes, thereby forming a nitrogen-enriched natural gas vapor and the nitrogen-depleted LNG product, and nitrogen-enriched natural gas vapor is withdrawn from the tank to form the recycle stream.

10. The method of claim 8, wherein the method further comprises expanding, partially vaporizing and separating the second LNG stream to produce additional nitrogen-enriched natural gas vapor for the recycle stream and additional nitrogen-depleted LNG product.

11. The method of claim 1, wherein step (c) comprises expanding and partially vaporizing an at least partially liquefied nitrogen-enriched natural gas stream and introducing said stream into the distillation column to separate the stream into vapor and liquid phases, wherein the at least partially liquefied nitrogen-enriched natural gas stream is formed from separating a nitrogen-enriched natural gas stream from the natural gas feed stream and at least partially liquefying said stream in the main heat exchanger.

12. The method of claim 11, wherein step (a) comprises (i) introducing the natural gas feed stream into the warm end of the main heat exchanger, cooling and at least partially liquefying the natural gas feed stream, and withdrawing the cooled and at least partially liquefied stream from an intermediate location of the main heat exchanger, (ii) expanding, partially vaporizing and separating the cooled and at least partially liquefied stream to form a nitrogen-enriched natural gas vapor stream and a nitrogen-depleted natural gas liquid stream, and (iii) separately re-introducing the vapor and liquid streams into an intermediate location of the main heat exchanger and further cooling the vapor stream and liquid streams in parallel, the liquid stream being further cooled to form the first LNG stream and the vapor stream being further cooled and at least partially liquefied to form the at least partially liquefied nitrogen-enriched natural gas stream.

13. The method of claim 12, wherein the method further comprises:

(g) expanding, partially vaporizing and separating the second LNG stream to form a nitrogen-depleted LNG product and a recycle stream composed of nitrogen-enriched natural gas vapor;

(h) compressing the recycle stream to form a compressed recycle stream; and (i) returning the compressed recycle stream to the main heat exchanger to be cooled and at least partially liquefied in combination with or separately from the natural gas feed stream.

14. The method of claim 13, wherein step (g) comprises expanding the second LNG stream, transferring the expanded stream into an LNG storage tank in which a portion of the LNG vaporizes, thereby forming a nitrogen-enriched natural gas vapor and the nitrogen-depleted LNG product, and withdrawing nitrogen-enriched natural gas vapor from the tank to form the recycle stream.

15. The method of claim 13, wherein the method further comprises expanding, partially vaporizing and separating the first LNG stream to produce additional nitrogen-enriched natural gas vapor for the recycle stream and additional nitrogen-depleted LNG product.

16. The method of claim 12, wherein:

step (a)(ii) comprises expanding, partially vaporizing and separating the cooled and at least partially liquefied stream to form the nitrogen-enriched natural gas vapor stream, a stripping gas stream composed of nitrogen-enriched natural gas vapor, and the nitrogen-depleted natural gas liquid stream; and step (c) further comprises introducing the stripping gas stream into the bottom of the distillation column.

17. The method of claim 1, wherein the liquefied or partially liquefied natural gas stream is introduced into the distillation column at an intermediate location of the column, and boil-up for the distillation column is provided by heating and vaporizing a portion of the bottoms liquid in a reboiler heat exchanger via indirect heat exchange with the liquefied or partially liquefied natural gas stream prior to introduction of said stream into the distillation column.

* * * * *